US007721687B1

(12) United States Patent
Lockshaw et al.

(10) Patent No.: US 7,721,687 B1
(45) **Date of Patent: *May 25, 2010**

(54) NON-RECIPROCATING, ORBITAL, INTERNAL COMBUSTION ENGINE

(76) Inventors: James Lockshaw, 4550 Oak Flat Rd., Paso Robles, CA (US) 93446; Joseph Gerondale, 4550 Oak Flat Rd., Paso Robles, CA (US) 93446

( * ) Notice: Subject to any disclaimer, the term of this patent is extended or adjusted under 35 U.S.C. 154(b) by 0 days.

This patent is subject to a terminal disclaimer.

(21) Appl. No.: 11/735,478

(22) Filed: Apr. 15, 2007

Related U.S. Application Data

(60) Provisional application No. 60/792,603, filed on Apr. 17, 2006.

(51) Int. Cl.
*F02B 75/18* (2006.01)

(52) U.S. Cl. ..... 123/52.1

(58) Field of Classification Search ..... 123/238, 123/232, 248, 249, 233, 234, 235, 236, 237, 123/204, 52.1; 418/206.1, 103, 13, 146, 418/143–145, 151, 94; 73/259
See application file for complete search history.

(56) References Cited

U.S. PATENT DOCUMENTS

| | | | | |
|---|---|---|---|---|
| 868,100 | A | 10/1907 | Krehbiel | |
| 1,109,270 | A | 9/1914 | Wallis | |
| 1,215,922 | A | 2/1917 | Fasnacht | |
| 1,705,130 | A | 3/1929 | McKlusky | |
| 1,742,706 | A | 1/1930 | Hermann | |
| 1,817,370 | A * | 8/1931 | Hammerstrom | 123/44 R |
| 2,894,496 | A | 7/1959 | Townsend | |
| 3,043,234 | A | 7/1962 | Poulin | |
| 3,084,562 | A | 4/1963 | Fitzpatrick | |
| 3,105,473 | A | 10/1963 | Johns | |
| 3,353,519 | A | 11/1967 | Reichart | |
| 3,550,565 | A * | 12/1970 | Sanchez | 123/238 |
| 3,942,913 | A | 3/1976 | Bokelman | |
| 4,236,496 | A * | 12/1980 | Brownfield | 123/212 |
| 4,432,314 | A * | 2/1984 | Pelekis | 123/238 |
| 4,530,316 | A | 7/1985 | Morrison | |
| 4,531,481 | A | 7/1985 | Haynes | |
| 4,836,149 | A | 6/1989 | Newbold | |
| 5,343,832 | A | 9/1994 | Murray | |
| 6,457,443 | B1 | 10/2002 | Lillbacka | |
| 6,526,925 | B1 | 3/2003 | Green, Jr. | |
| 6,591,791 | B2 | 7/2003 | De Bei | |
| 6,615,793 | B1 | 9/2003 | Usack | |
| 6,705,202 | B2 | 3/2004 | Harcourt et al. | |
| 6,779,433 | B2 | 8/2004 | Brosch et al. | |
| 7,341,042 | B1 * | 3/2008 | Chung et al. | 123/232 |

* cited by examiner

*Primary Examiner*—Stephen K Cronin
*Assistant Examiner*—Keith Coleman
(74) *Attorney, Agent, or Firm*—Louis J. Bachand

(57) ABSTRACT

A combustible fluid operated engine free of lost momentum during piston reciprocation has respective series of cylinders and pistons on counter-rotating carrier wheels. Fuel is injected into the cylinders from the pistons. The carrier wheels are variably spaced relatively to vary the combustible fuel compression. The power output is variable.

50 Claims, 9 Drawing Sheets

NON-RECIPROCATING, ORBITAL, INTERNAL COMBUSTION ENGINE

CROSS-REFERENCE TO RELATED APPLICATIONS

This application claims the benefit of U.S. Provisional Application Ser. No. 60/792,603, filed Apr. 17, 2006, the specification and drawings of which are hereby incorporated by reference.

BACKGROUND OF THE INVENTION

1. Field of the Invention

This invention relates to engines, including motors, of the internal combustion type, and in a specific case to reciprocating engines free of momentum change in the movement of their piston and cylinder parts.

More particularly, the invention is concerned with improving the basic internal combustion engine by eliminating many of the commonly associated albeit peripheral parts such as coolant systems, lubrication apparatus, and crankshafts that add weight, drain horsepower and cost efficiency. Further, by eliminating reciprocation of pistons, energy usually lost to reversing piston momentum within the engine is regained. By redesign and optimization of all facets of the internal combustion process we are able to present an engine that has a remarkably high horsepower to weight ratio, operates efficiently at low and high rpms, and runs on virtually any combustible fluid, including synfuels and biofuels as well as conventional hydrocarbon fuels and in different modes including diesel mode.

The invention uses an optimized cylinder and piston assembly and avoids e.g. Wankel rotor and stator assemblies that have proved expensive to build and hard to maintain.

The invention carries cooperating piston and cylinder pairs on separate, but intersecting, angularly counter-rotating carrier wheels to achieve interfittment in their relative movement but without the reversal of momentum that characterizes prior art devices. Momentum in the invention engine is angular and is never reversed, giving an inherent flywheel effect.

By carrying the cooperating cylinder/piston pairs at a chordal disposition relative to the circles defined by their respective carrier wheel, and mutually coordinating their junction in timed relation, pistons enter their cylinders in coaxial disposition, eliminating hitherto required complex mechanisms to tilt the pistons or cylinders into mating orientations. The thus carried pistons being fixed on the wheel are readily used without intricate fittings to deliver by injection combustible fluid fuel to the cylinder once interfittment is achieved for mixing with air or other combustible gases within the cylinder volume also simply in view of the fixed nature of the cylinders on their carrier wheel. Progressive penetration of the cylinder by the piston body, necessarily effected by the intersecting angular paths of the respective carriers, compresses the air fuel mixture as the cylinder exhaust port is closed or partially closed suitably by a spring biased valve and valve controller against escape of the mixture, as will be described.

Fuel detonation is typically by a spark plug or similar device, or by compression as in a diesel. Injection of fuel is controlled for efficiency and can be varied in volume, timing and shape for the application presented. Similarly, fully or partially maintaining cylinder exhaust port valve closure provides a means of varying engine output while maintaining the angular rotation of the carrier wheels constant by varying the amount of combustible mixture under piston compression in proportion to cracking or not of the valve before detonation. A further variation in output is provided by varying the piston stroke suitably while maintaining carrier wheel angular rotation and piston and cylinder positioning constant by moving the carrier wheels more or less apart to vary the active cylinder volume and thus fuel mixture compression without changing the basic operation of the wheels, pistons and cylinders. These designed-in variabilities in mode of operation enable tailoring the engine to a wide variety of applications and to the use of many different fuels.

Once the fuel is detonated, the exhaust port being closed, the piston and cylinder are driven apart thereby and their movement impels their respective carrier wheels to further rotation effecting rotation of a power take off shaft coupled to either or both carrier wheel hubs for e.g. powering vehicle movement. Auxiliary devices such as a blower can be driven off the power take off as well. Upon fuel detonation and concomitant piston withdrawal, the cylinder exhaust port valve, generally disposed at the bottom of the cylinder opposite the face of the piston, and adjacent the spark plug if present, is opened. The exhaust gases are vented out of the cylinder via the valved exhaust port in the cylinder bottom wall, e.g. to a catalytic converter.

Heat from combustion is cooled from the piston and cylinder by exposing these parts to coolant typically comprising only ambient air as they are carried circularly toward their next conjunction. The pistons and cylinders are completely separated by withdrawal of the piston from its cooperating cylinder facilitating their respective cooling. The cylinder exhaust port is open and ambient air coolant can enter and pass through the cylinder volume from bottom and top.

2. Description of the Related Art

Engines using rotary components rather than reciprocating are known. Reciprocation of pistons and or cylinders is achieved in this invention without change in momentum using chordally (not radially) disposed and angularly carried cylinders intersecting with chordally (not radially) disposed oppositely carried pistons for interfittment in coaxial relation; thus are the complications of radial disposition systems, such as cooperating parts being relatively rounded to mate properly, with an accompanying loss of efficiency, and/or parts pivotally brought into alignment for interfittment requiring beefy aligning gearing to withstand the forceful shocks of repeated detonations between the interfitted parts.

BRIEF SUMMARY OF THE INVENTION

As noted, the invention engine features an absence of direction-reversing action of the pistons and piston rods, this eliminates the inertial losses associated with reverse-type reciprocation. Further, pistons and cylinders are in constant orbital motion. Pistons and cylinders are in direct alignment throughout the compression and power cycle eliminating connecting rod angular oscillation; this minimizes frictional losses between pistons and cylinders. The greater lever arm advantage inherent in the invention engine results in higher torsional forces, allowing for low RPM operation and less engine wear. The invention engine has no crankshaft, no block, no connecting rods and no wrist pins to complicate the engine. The invention engine has no piston rings, sealing and oiling is achieved at the bottom of the cylinder by nonmetallic materials and this results in less wear on pistons and cylinders. There is no flywheel. Flywheel inertia is inherent in this engine design. There is only one valve, and thus less supporting hardware. The engine is air cooled from inside and outside of cylinders and pistons eliminating a radiator, water pumps, hoses, and like parts that are peripheral to an engine's main function. All cylinders complete a power stroke with each carrier wheel revolution. Variable compression pressures can automatically adjust for different fuels and greatly increase the efficiency of combustion, reducing pollution, eliminating engine knock and allowing for the use of available fuel including synfuels and biofuels. There is automatic variable exhaust valve control, allowing changes in displacement of the engine to effectively control engine horsepower to the level needed. This reduces the number of transmission gears required on vehicles and improves engine efficiency. Direct injection of the fuel through the piston provides optimum air/fuel mixing and increased combustion efficiency. The engine is suited for diesel operation by merely increasing compression and injector pressure as the engine design readily permits.

It is an object of the invention to meet the continuing need for engines offering the benefits of freedom from reciprocation-generated momentum changes, simplified construction, flexibility in fuels, variable output, high horsepower to weight ratios, and other benefits, including those noted above and hereinafter, that better match the power and efficiency needs of a modern economy.

These and other objects of the invention to become apparent hereinafter are realized in the invention combustible fluid operated engine, comprising a series of angularly carried cylinders adapted to receive the combustible fluid, and a cooperating series of oppositely angularly carried pistons arranged to coaxially oppose and sequentially enter and completely withdraw from respective ones of the cylinders in combustible fluid introducing, compressing, detonating and exhausting relation repetitively as a function of the relative angular carriage of the cylinders and pistons.

In this and like embodiments, typically the cylinders are carried on a cylinder wheel, the pistons are carried on a piston wheel, and the cylinder and piston wheels counter-rotate and are opposed edgewise and disposed in the same plane, the cylinder and piston wheels rotate on respective hubs, the hubs having plates defining the wheels, and including also a hub coupled power take off, there is also included a combustible fluid supply in fluid communication with each piston for delivery thereby into the respective ones of the cylinders in timed relation with piston cylinder entry for compression, detonation and exhaust, each cylinder has an exhaust port closable during piston entry in combustible fluid compression aiding relation, the cylinder exhaust port is at least partially openable during entry of the piston in combustible fluid compression varying relation, the cylinder exhaust port is open between successive piston entries into the cylinder in coolant passing relation into the cylinder, the engine further includes an exhaust port control valve controlling between the open and closed states of the exhaust port in timed relation with the angular carriage of the cylinder, each cylinder has an exhaust port closable during piston entry in combustible fluid compression aiding relation, the cylinder exhaust port is at least partially openable during entry of the piston in combustible fluid compression varying relation, the engine further includes an exhaust port control valve controlling between the open and closed states of the exhaust port in timed relation with piston entry into and withdrawal from the cylinder, the cylinders are carried on a cylinder wheel, the pistons are carried on a piston wheel in counter-rotating relation relative to the cylinder wheel, the cylinder and piston wheels being opposed edgewise and disposed in the same plane and supported by a frame, there is further included a frame, the cylinder and piston wheels rotating on respective hubs journaled on the frame, and there is also a hub coupled power take off, the respective hubs are relatively movable in piston-stroke-within-the-cylinder varying relation, the cylinder wheel carries multiple circularly distributed, chordally disposed cylinders at all angles of rotation of the cylinder wheel, the cylinders being open to cooperating pistons carried by the piston wheel, the piston wheel carries multiple circularly distributed, chordally disposed pistons at all angles of rotation of the piston wheel, the pistons being registerable with cooperating cylinders carried by the cylinder wheel, there is further included a combustible fluid supply in fluid communication with each piston for delivery thereby into the respective ones of the cylinders in timed relation with piston cylinder entry for compression, detonation and exhaust, there is further a combustible fluid detonator operatively associated with each cylinder such as a spark plug having a tip within the cylinder.

In a further embodiment, the invention provides a combustible fluid operated engine comprising a cylinder or piston angularly translatable in chordal disposition on a first driven wheel extending in a plane, a piston or cylinder respectively counter angularly translatable in chordal disposition on a second driving wheel extending in the plane, the first and second wheels being relatively arranged to interfit periodically the piston increasingly with the cylinder angular translation, and an energy supply to the cylinder for decreasing cylinder and piston interfittment.

In this and like embodiments, typically, the cylinders are carried on a cylinder wheel, the pistons are carried on a piston wheel, and the cylinder and piston wheels counter-rotate and are opposed edgewise and disposed in the same plane, the cylinder and piston wheels rotate on respective hubs, the hubs having plates defining the wheels, there is further included a combustible fluid supply in fluid communication with each piston for delivery thereby into the respective ones of the cylinders in timed relation with piston cylinder entry for compression, detonation and exhaust, each cylinder has an exhaust port closable during piston entry in combustible fluid compression aiding relation, the cylinder exhaust port is at least partially openable during entry of the piston in combustible fluid compression varying relation, the cylinder exhaust port is open between successive piston entries into the cylinder in coolant passing relation into the cylinder, the engine further includes an exhaust port control valve controlling between the open and closed states of the exhaust port in timed relation with the angular carriage of the cylinder, the engine also includes a frame, and the cylinder and piston wheels rotate on respective hubs journaled on the frame, and also including a hub coupled power take off, and the respective hubs are relatively movable in piston stroke within the cylinder varying relation.

In a further embodiment, the invention provides a combustible fluid operated engine having a power output, the engine comprising a cooperating cylinder and piston structure, the cylinder having a first axis, the piston having a first axis, a cylinder carrier wheel rotating on a cylinder carrier wheel hub and carrying the cylinder on a cylinder circular path in a first angular direction with the cylinder first axis chordally disposed to the cylinder circular path, a piston carrier wheel rotating on a piston carrier wheel hub parallel to and spaced from the cylinder wheel carrier and carrying the piston on a piston circular path in a second angular direction counter to the first angular direction with the piston first axis chordally disposed to the piston circular path and to the cylinder circular path, the cylinder and piston circular paths locally intersecting in cylinder and piston increasing and then decreasing interfitting relation, a detonatable fuel supply for detonating fuel within the cylinder in piston and cylinder decreasing interfitting relation to drive a carrier wheel, the driven carrier wheel being coupled to the power output in driving relation.

In its method aspects the invention contemplates a method of operating a combustible fluid operated engine, including angularly translating a cylinder in chordal disposition on a first circular path extending in a plane, oppositely angularly translating a cooperating piston in chordal disposition on a second circular path extending in the plane and that periodically intersects the first circular path in piston-in-cylinder increasing interfitting relation, and supplying energy between the cylinder and the piston in piston and cylinder decreasing interfitting relation.

The invention methods further include a method of operating a combustible fluid operated engine, including coaxially opposing and sequentially interfitting a series of angularly carried cylinders adapted to receive the combustible fluid and a cooperating series of oppositely angularly carried pistons, and thereafter completely withdrawing the pistons from respective ones of the cylinders in combustible fluid introducing, compressing, detonating and exhausting relation repetitively as a function of the relative angular carriage of the cylinders and pistons.

In this and like embodiments, typically, the method includes carrying the cylinders on a cylinder wheel, carrying the pistons on a piston wheel, counter-rotating the cylinder and piston wheels in edgewise opposed relation and disposed in the same plane, supplying a combustible fluid via each piston into the respective ones of the cylinders in timed relation with piston cylinder entry for compression, detonation and exhaust, maintaining closed within the cylinder an exhaust port during piston entry in combustible fluid compression aiding relation, maintaining the cylinder exhaust port at least partially open during entry of the piston in combustible fluid compression varying relation, and/or varying the spacing between the cylinder and piston wheels in piston stroke limiting relation.

BRIEF DESCRIPTION OF THE SEVERAL VIEWS OF THE DRAWINGS

The invention will be further described in conjunction with the attached drawings in which:

FIGS. 5-1 and 5-4 are upper left portion and lower left portion respectively of a sexpartite top plan view of a left and first zone of the invention engine in one embodiment;

FIGS. 5-2 and 5-5 are an upper center portion and a lower center portion respectively of a sexpartite top plan view of a center and second zone of the invention engine in this embodiment;

FIGS. 5-3 and 5-6 are an upper right portion and a lower right portion respectively of a sexpartite top plan view of a right and third zone of the invention engine; and FIG. 6 is an oblique view of the engine.

DETAILED DESCRIPTION OF THE PREFERRED EMBODIMENTS

In General

Figure 1:
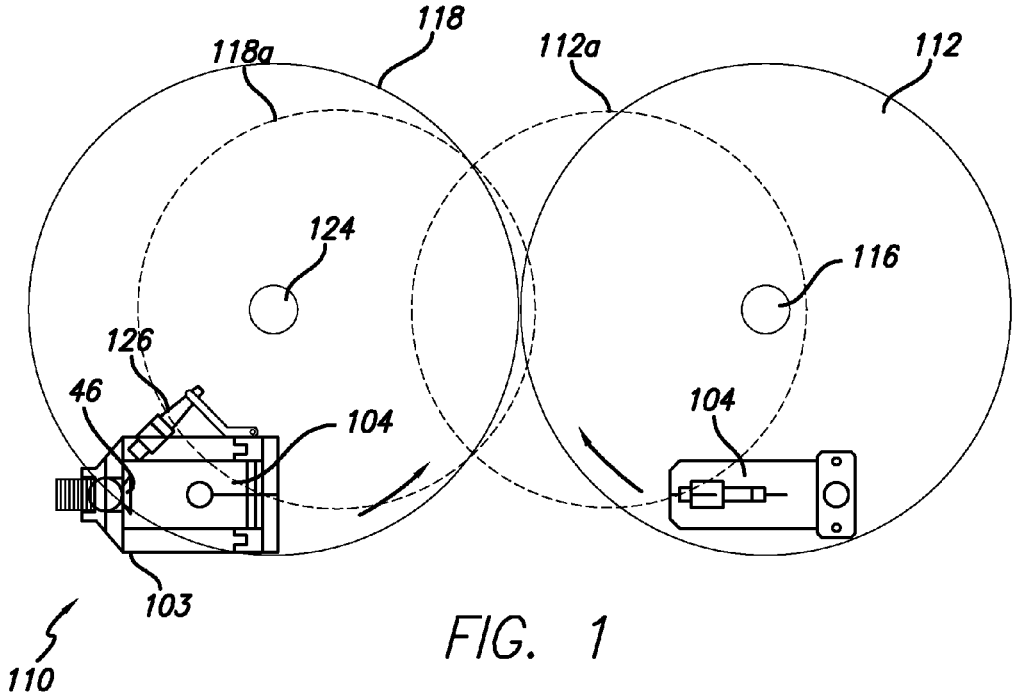
FIGS. 1-4 are progressive schematic depictions of a side elevation view of the engine with the piston and cylinder approaching, interfitting and withdrawing as a result of their indicated travel paths as defined by their respective carrier wheels.

With reference to FIGS. 1-6, the invention combustible fluid operated engine 110 comprises a series of angularly carried cylinders 103 adapted to receive the combustible fluid, and a cooperating series of oppositely angularly carried pistons 104 arranged to coaxially oppose and sequentially enter and completely withdraw from respective ones of the cylinders in combustible fluid introducing, compressing, detonating and exhausting relation repetitively as a function of the relative angular carriage of the cylinders and pistons.

Cylinders 103 are carried on a cylinder wheel 118; the pistons 104 are carried on a piston wheel 112. Cylinder and piston wheels 118, 112 counter-rotate and are opposed edgewise and disposed in the same plane, as shown. Cylinder and piston wheels 118, 112 rotate on respective hubs 82, 81, the cylinder hub having plates 83, 84, the piston hub having plates 85, 86 that defining the respective wheels, and at least in the case of the cylinder hub provide a hub coupled power take off.

A combustible fluid supply S is in fluid communication with each piston 104 for delivery thereby into the respective ones of the cylinders 103 in computer control module M-controlled timed relation (and sensor responsive relation as well) with piston cylinder entry for compression, detonation and exhaust. Each cylinder 103 has an exhaust port 111 closable during piston 104 entry in combustible fluid compression aiding relation. The cylinder exhaust port 111 is at least partially openable during entry of the piston 104 in combustible fluid compression varying relation. The cylinder exhaust port 111 is open between successive piston 104 entries into the cylinder 103 in coolant passing relation into the cylinder.

The engine 110 further includes an exhaust port control valve 46 controlling between the open and closed states of the exhaust port 111 in timed relation with the angular carriage of the cylinder 103.

The cylinders 103 are carried on the cylinder wheel 118, while the pistons 104 are carried on piston wheel 112 in counter-rotating relation relative to the cylinder wheel. The cylinder and piston wheels 118, 112 are opposed edgewise and disposed in the same plane and supported e.g. by a frame 115. The cylinder and piston wheels 118, 112 rotate on respective hubs 82, 81 journaled on the frame 115, the hubs providing a hub coupled power take off such as shaft continuation 82*a* of hub 82 where blower pulley 82*b* is mounted.

The respective hubs 81, 82 are relatively movable in piston 104 stroke-within-the-cylinder-varying relation. Cylinder wheel 118 carries multiple circularly distributed, chordally disposed cylinders 103 at all angles of rotation of the cylinder wheel, the cylinders being open to cooperating pistons 104 carried by the piston wheel 112. In turn, the piston wheel 112 carries multiple circularly distributed, chordally disposed pistons 104 at all angles of rotation of the piston wheel, the pistons being registerable with cooperating cylinders 103 carried by the cylinder wheel 118. A combustible fluid supply S is in fluid communication with each piston 104 for delivery thereby into the respective ones of the cylinders 103 in timed relation with piston cylinder entry for compression, detonation and exhaust. A combustible fluid detonator is operatively associated with each cylinder such as a spark plug 126 having a tip within the cylinder 103.

More specifically, the invention combustible fluid operated engine 110 comprises a cylinder 103 or piston 104 angularly translatable in chordal disposition on a first driven wheel 118, 112 extending in a plane, a piston 104 or cylinder 103 respectively counter angularly translatable in chordal disposition on a second driving wheel 112, 118 extending in the plane, the first and second wheels being relatively arranged to interfit periodically the piston increasingly with the cylinder angular translation, and an energy supply S to the cylinder for decreasing cylinder and piston interfittment.

The invention further provides a combustible fluid operated engine 110 comprising a cylinder 103 or piston 104 angularly translatable in chordal disposition on a first driven wheel 112/118 extending in a plane, a piston 104 or cylinder 103 respectively counter angularly translatable in chordal disposition on a second driving wheel 118/112 extending in the plane, the first and second wheels being relatively arranged to interfit periodically the piston increasingly with the cylinder angular translation, and an energy supply S to the cylinder for decreasing cylinder and piston interfittment.

The cylinders 103 are carried on a cylinder wheel 118, the pistons 104 are carried on a piston wheel 112, supported for rotation by their respective axles and the cylinder and piston wheels counter-rotate and are opposed edgewise and disposed in the same plane. Further, the cylinder and piston wheels 118, 112 rotate on respective hubs 82, 81, the hubs having plates 83, 84, 85 and 86 defining the wheels, and there is further included a combustible fluid supply S in fluid communication with each piston for delivery thereby into the respective ones of the cylinders in timed relation with piston cylinder entry for compression, detonation and exhaust. Each cylinder 103 has an exhaust port 111 closable during piston entry in combustible fluid compression aiding relation. The cylinder exhaust port 111 can be at least partially openable during entry of the piston 104 in combustible fluid compression varying relation. The cylinder exhaust port 111 is open between successive piston 104 entries into the cylinder 103 in coolant passing relation into the cylinder. The engine further includes an exhaust port control valve 46 controlling between the open and closed states of the exhaust port 111 in timed relation with the angular carriage of the cylinder 103. The engine also includes a frame 115, and the cylinder and piston wheels 118, 112 rotate on respective hubs 81, 82 journaled on the frame. There is a hub 81, 82 coupled power take off, and the respective hubs are relatively movable in piston-stroke-within-the-cylinder varying relation.

Further, the invention provides a combustible fluid operated engine 110 having a power output, the engine comprising a cooperating cylinder 103 and piston 104 structure. Cylinder 103 has a longitudinal axis C-C, piston 104 has the same longitudinal axis P-P, these longitudinal axes being at all times parallel with the longitudinal axes of each other cooperating cylinder and piston. There is a cylinder carrier wheel 118 rotating on a cylinder carrier wheel hub 82 carrying the cylinder on a cylinder circular path 118*a* in a first angular direction with the cylinder first axis chordally disposed to the cylinder circular path. There is a piston carrier wheel 112 rotating on a piston carrier wheel hub 82 parallel to and spaced from the cylinder wheel carrier hub 82 and carrying the piston on a piston circular path 112*a* in a second angular direction counter to the first angular direction with the piston first axis chordally disposed to the piston circular path and to the cylinder circular path. The cylinder and piston circular paths 118*a*, 112*a* locally intersect in cylinder and piston increasing and then decreasing interfitting relation. A detonatable fuel is supplied for detonating within the cylinder in piston 104 and cylinder 103 decreasing interfitting relation to drive a carrier wheel 118, 112, the driven carrier wheel being coupled to the power output P in driving relation.

The invention method of operating a combustible fluid operated engine 110 includes angularly translating a cylinder 103 in chordal disposition on a first circular path 118*a* extending in a plane, oppositely angularly translating a cooperating piston 104 in chordal disposition on a second circular path 112*a* extending in the plane and that periodically intersects the first circular path in piston-in-cylinder increasing interfitting relation, and supplying energy between the cylinder and the piston in piston and cylinder decreasing interfitting relation.

A further invention method of operating a combustible fluid operated engine includes coaxially opposing and sequentially interfitting a series of angularly carried cylinders 103 adapted to receive the combustible fluid and a cooperating series of oppositely angularly carried pistons 104, and thereafter completely withdrawing the pistons from respective ones of the cylinders in combustible fluid introducing, compressing, detonating and exhausting relation repetitively as a function of the relative angular carriage of the cylinders and pistons.

The method further can include carrying the cylinders 103 on a cylinder wheel 118, carrying the pistons 104 on a piston wheel 112, counter-rotating the cylinder and piston wheels in edgewise opposed relation and disposed in the same plane, supplying a combustible fluid via each the piston into the respective ones of the cylinders in timed relation with piston cylinder entry for compression, detonation and exhaust, maintaining closed within the cylinder an exhaust port 111 during piston entry in combustible fluid compression aiding relation, maintaining the cylinder exhaust port 111 at least partially open during entry of the piston in combustible fluid compression varying relation, and/or varying the spacing between the cylinder and piston wheels in piston stroke limiting relation.

Overview

The basic movement of the pistons and cylinders of invention engine 110 is schematically illustrated in FIGS. 1-4. An illustrative piston carrier wheel 112 carrying piston 104 is rotating clockwise (CW) on a circular path 112*a* about an axle 116 (hub 81). An illustrative cylinder carrier wheel 118 carrying cylinder 103 is shown rotating counter clockwise (CCW) on a circular path 118*a* about axle 124 (hub 82) that is parallel with axle 116 and spaced therefrom a distance (which can be varied for varying the interfittment of piston 104 and the cylinder and thus compression realized) as shown. Path 118*a* of cylinder 103 intersects path 112*a* of piston 104 as shown. Piston 104 and the cylinder 103 are disposed chordally (i.e. pistons and cylinders extend on an imaginary line that intersects the circular paths in two places without passing through the circle center, as represented by axles 116, 124) to the paths 112*a* and 118*a* respectively (the paths being representative of the cylinder 103 and piston 104 carrier wheels perimeters). Being thus carried and coordinated and relatively timed in their movement by gearing G, 117 the piston 104 and cylinder 103 are in paraxial alignment as they approach each other (FIG. 1), coaxially aligned as their paths intersect (FIG. 2) and again paraxially aligned as they depart each other (FIG. 3), and continue on their respective paths (FIG. 4) as shown. Fuel supply S to the cylinder 103 is via the piston 104 during the interfitting stroke and detonation is effected by spark plug 126 such that the piston is driven backward from interfittment, with the reaction force driving the cylinder carrier wheel 118 counterclockwise to a power take off such a rotating shaft extension of the cylinder wheel hub (not shown). The carrier wheels 112, 118, then rotate under the explosive impetus of this detonation to bring a further cylinder 103 and a further piston 104 together in a circular cycle.

Control of the sole exhaust valve 46 in each cylinder 103 includes closing the valve when the piston 104 enters the cylinder 103 for full horsepower output, fuel is injected during the compression cycle, spark plug 126 ignites the fuel, the exhaust valve 46 opens to vent the exhaust gases before the piston 104 leaves the cylinder 103. The exhaust valve 46 then remains open through the rest of the rotation cycle allowing fresh air or other coolant to cool the cylinder 103 and replenish air in the cylinder. With lower horsepower requirements the exhaust valve 46 remains open (by an adjustable cam AC, FIGS. 5-3, 5-6) until the piston 104 has traveled as much as ⅔ the length of the cylinder 103 and then closes, effectively reducing the quantity of air in the cylinder volume 119. Concurrently, the piston and cylinder carrier wheels 112, 118 can be moved closer together (by a small amount) reducing the volume 121 (FIG. 3) of the combustion chamber to maintain the original compression ratio if desired. Thus, horsepower output can be varied to suit power requirements and greatly improve efficiency.

Specific Embodiments

Figures 1, 5:
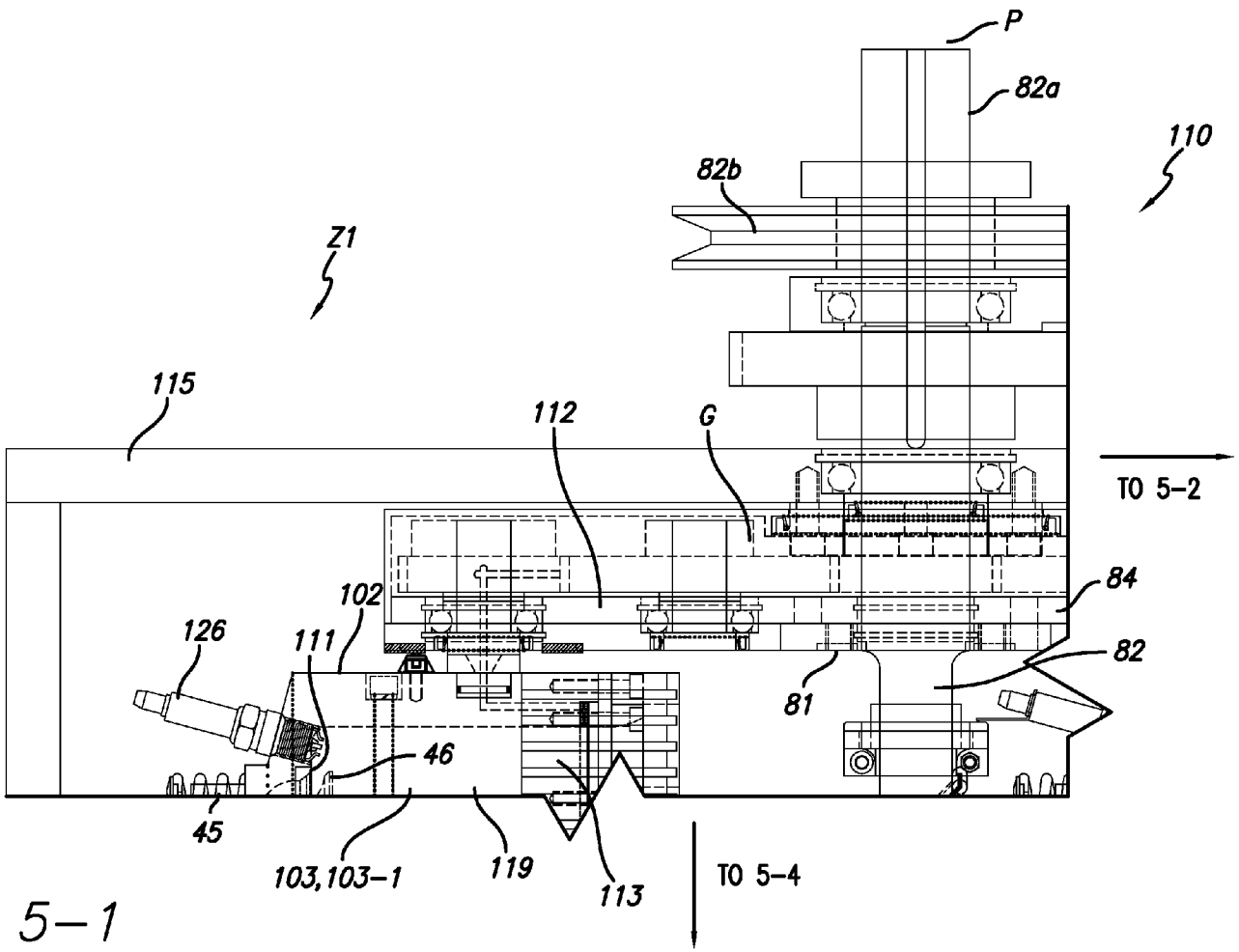
Figures 2, 5:
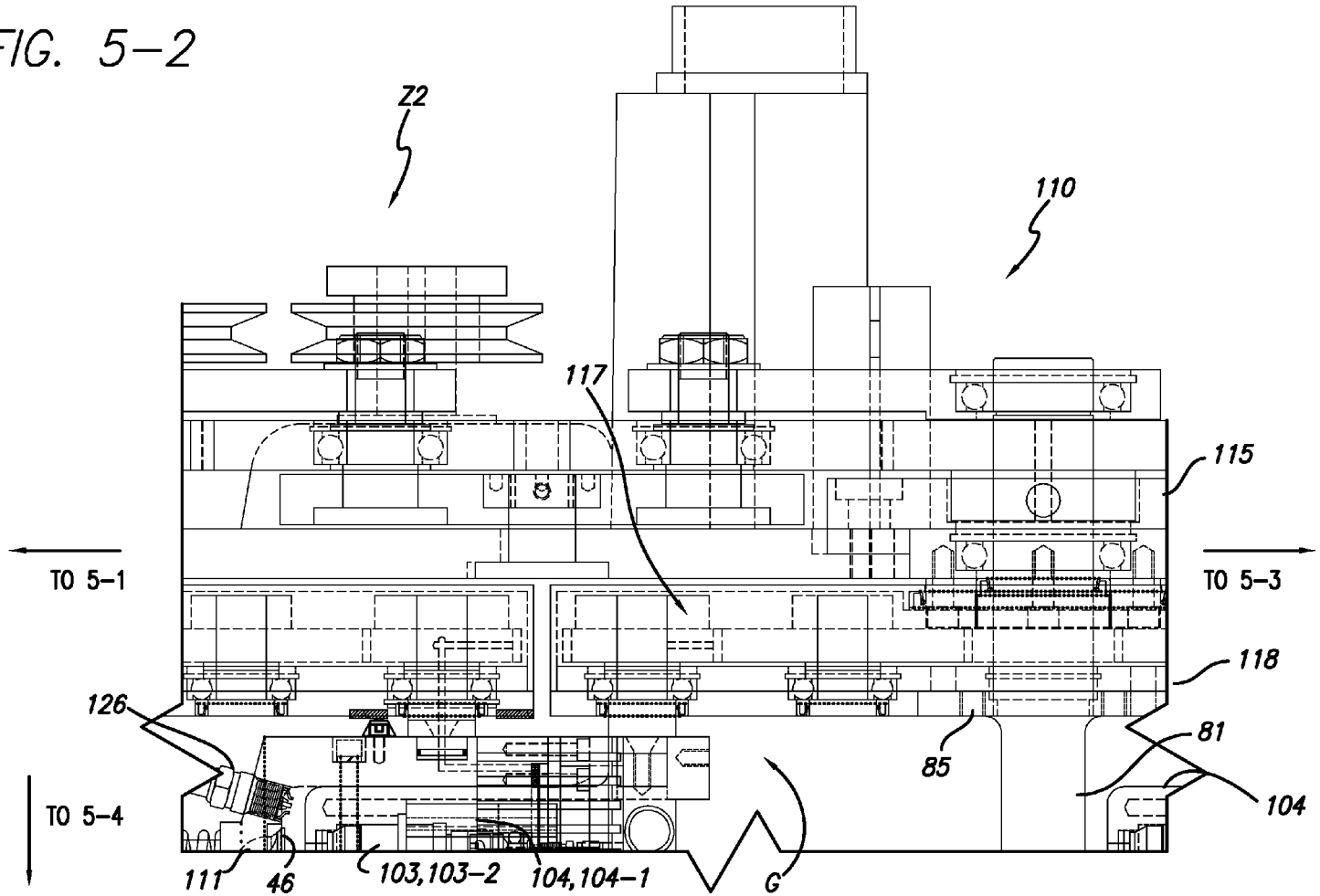
Figures 3, 5:
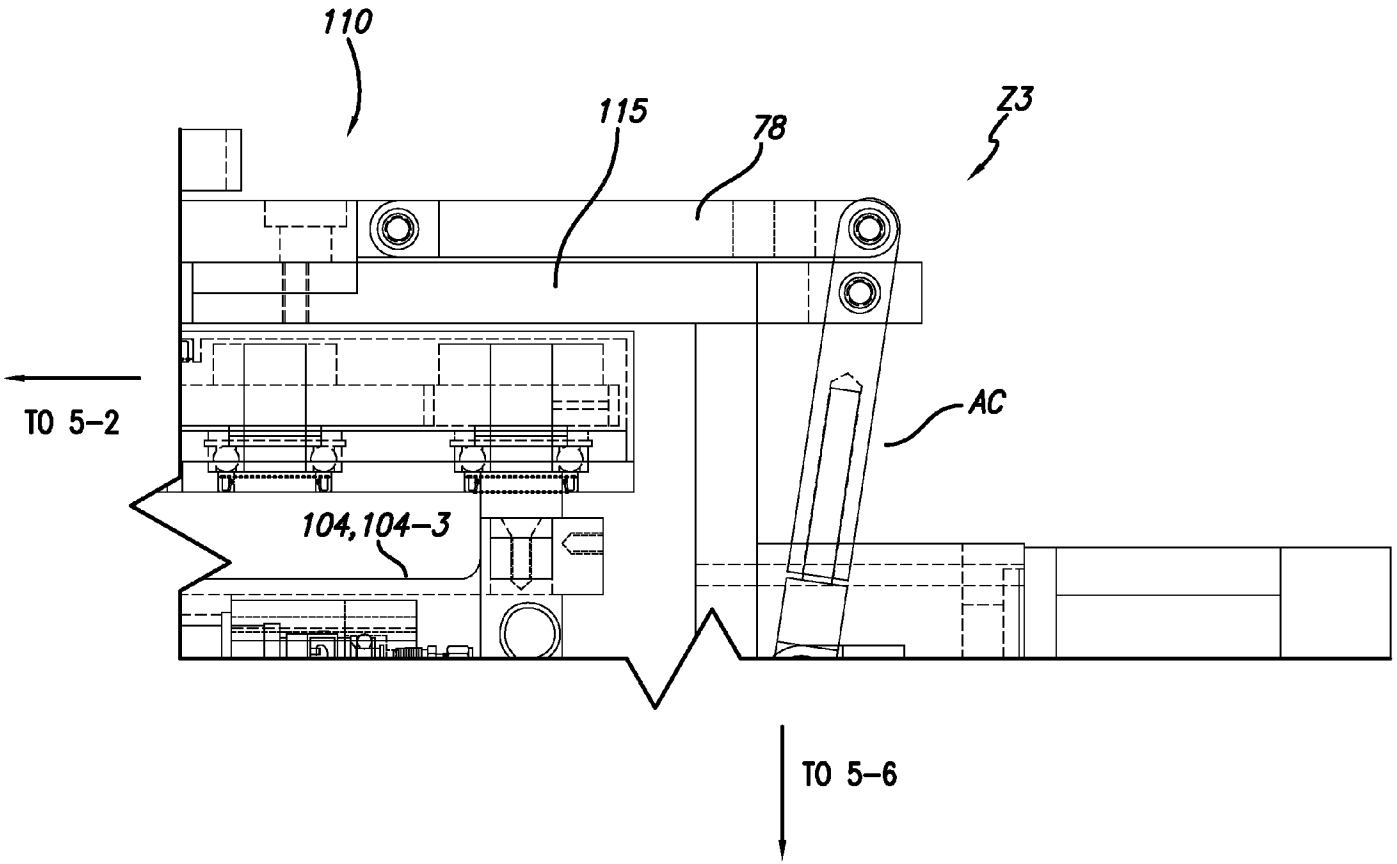
Figures 4, 5:
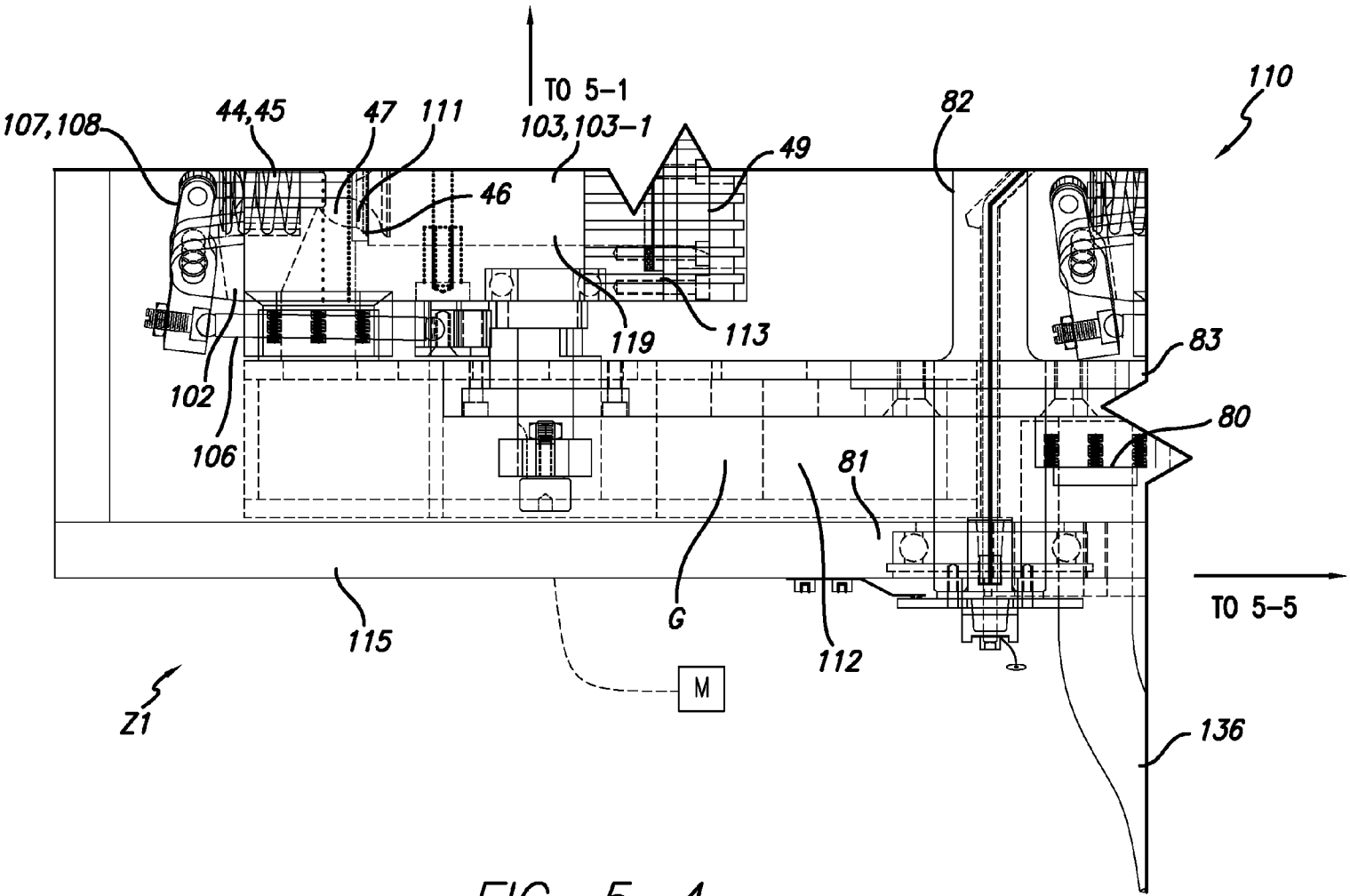
Figure 5:
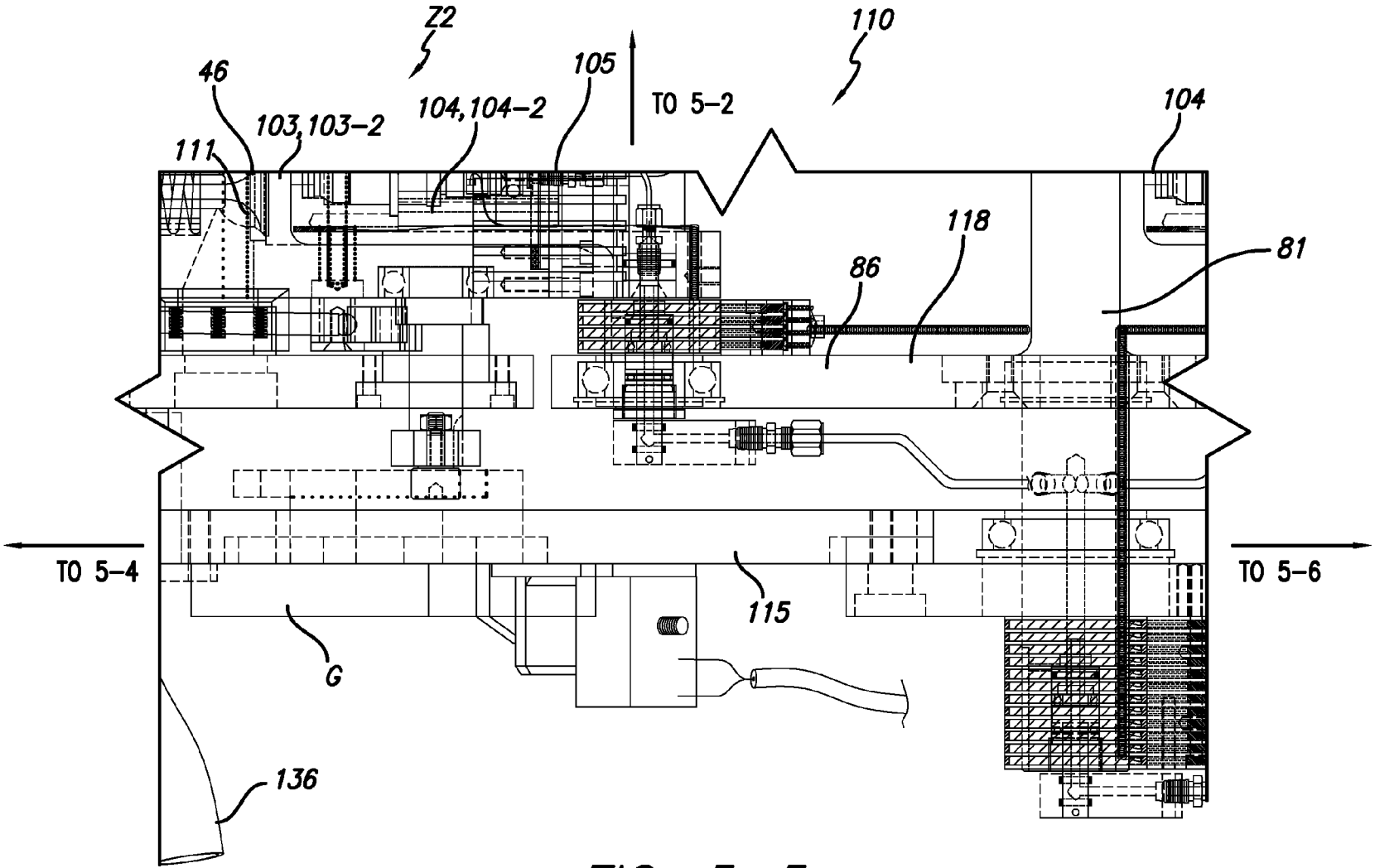

In the ensuing description, left, right and center, and upper and lower are used with reference to the FIGS. 5-1, and following; in practice the engine 110 can be arranged in various orientations.

Figures 5, 6:
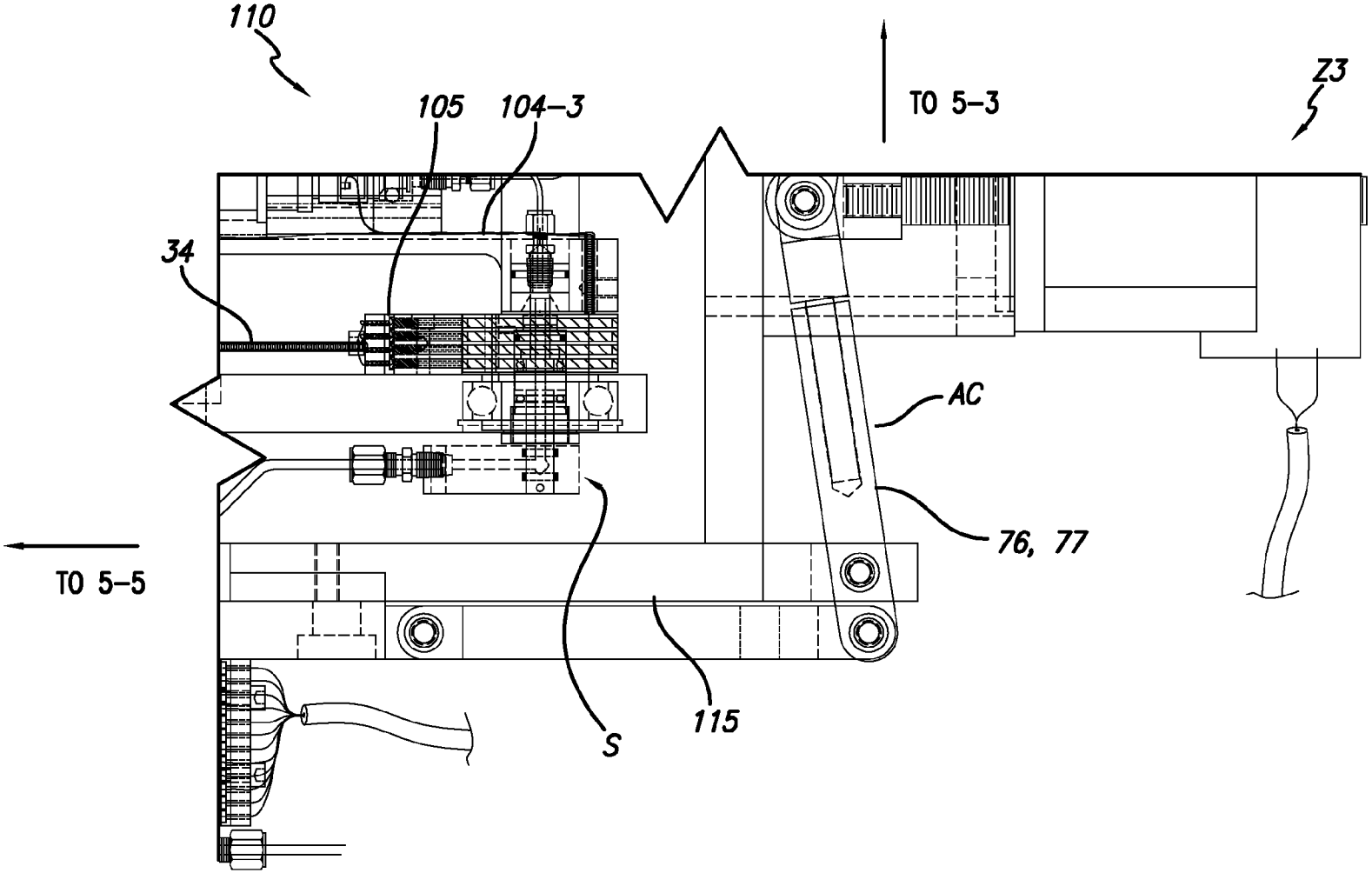
Figure 6:
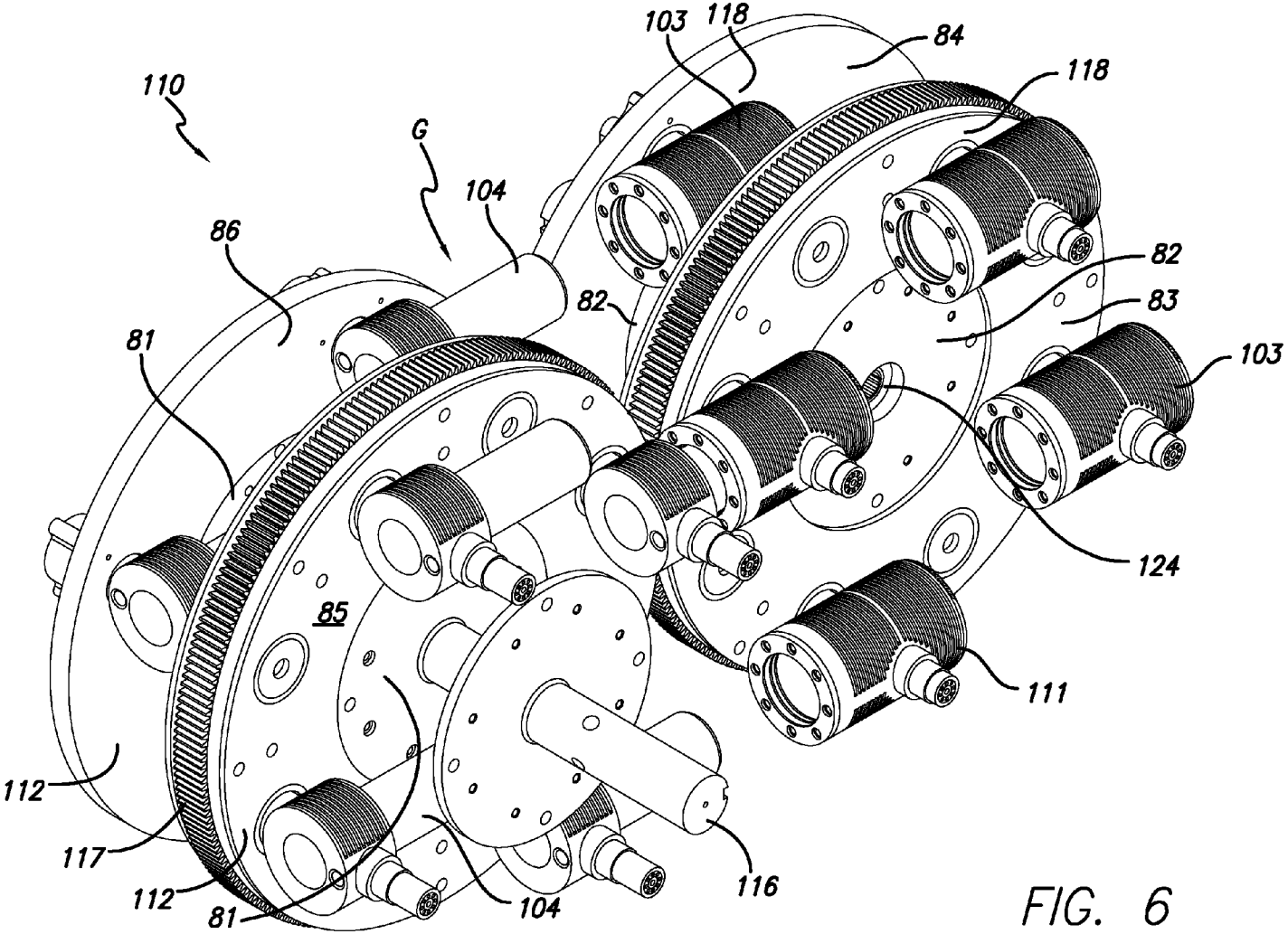

With reference to FIGS. 5-1 to 5-6, an embodiment of the engine 110 is shown having four cylinders 103 carried on a single cylinder carrier wheel 118 and four pistons 104 carried on a piston carrier wheel 112. The number of cylinder and piston pairs can be varied as can the number of engines 110 connected together, e.g. by stacking with wheel hubs interconnected. Engine 110 is shown to have for purposes of description three zones, left, center and right, labeled Z1, Z2, and Z3; in practice the engine is an integrated whole.

The first zone Z1 corresponding to the left side of the engine 110 is shown to comprise a portion of the cylinder carrier wheel 118 and a cylinder 103-1 and related parts to be described. Second zone Z2 corresponding to the center portion of the engine 110 is shown to comprise a second cylinder 103-2 and piston 104-2 carried by piston carrier wheel 112 and fully within the cylinder 103-2 carried by cylinder carrier wheel 118 and related parts to be described. Third zone Z3 corresponding to the right side of the engine 110 is shown to comprise a portion of the piston carrier wheel 112 and a piston 104-3 and related parts to be described.

Figure 4:
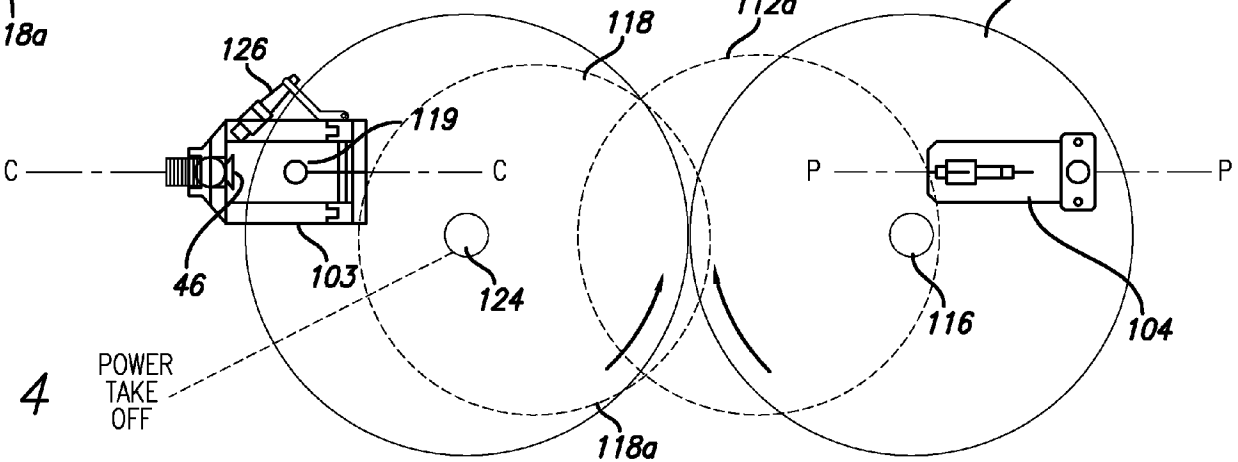

FIGS. 5-1 and 5-4 depict engine zone Z1 and show respectively the upper left and lower left side of this embodiment of the invention engine 110. Principal gearing 117 for the engine 110 is on the upper side and this region will be referred to as the engine gear side or gear side. The other or lower side of engine 110 will be referred to as lower engine side. Characteristic of the engine first zone Z1 is the presence of an empty cylinder 103-1 that is being carried on carrier wheel 118 angularly downward in the Figures in a cooling mode following detonation and piston withdrawal. Cylinder carrier wheel 118 is partially shown and has a hub 82 that is useable as a power take-off beyond the gear side of the engine 110. Cylinder hub 82 extends normal to the plane of wheel 118 (parallel to the paper) and coincides with the wheel axis 124. Cylinder wheel 118 comprises a lower side cylinder wheel plate 83 and a gear side cylinder wheel upper plate 84. A frame 115 having bearings 8 supports the hub 82 and thus the cylinder wheel 118 in journaled relation.

Cylinder 103-1 has a topmost piston-receiving opening 113 letting in to cylinder volume 119 and a bottom-most exhaust port 111. Exhaust valve 46 extends through valve guide 47 and is spring loaded via compression valve spring 45 and valve spring retainer 44. Rocker arm 107 and rocker arm adjuster 108 carried on the cylinder head 102 control movement of the valve 46 under actuation by push rod 106. A spark plug 126 extends into cylinder volume 119 to provide ignition of air-fuel mixture in Zone Z2. Exhaust housing bushing 80 is shown on cylinder 103-1 for later registration with the exhaust housing 136 (Zone Z2). Gearing 117 linking cylinder wheel hub 82 and piston wheel hub 81 is supported on the frame 115 on the side thereof opposite cylinder wheel 103-1.

Figure 2:
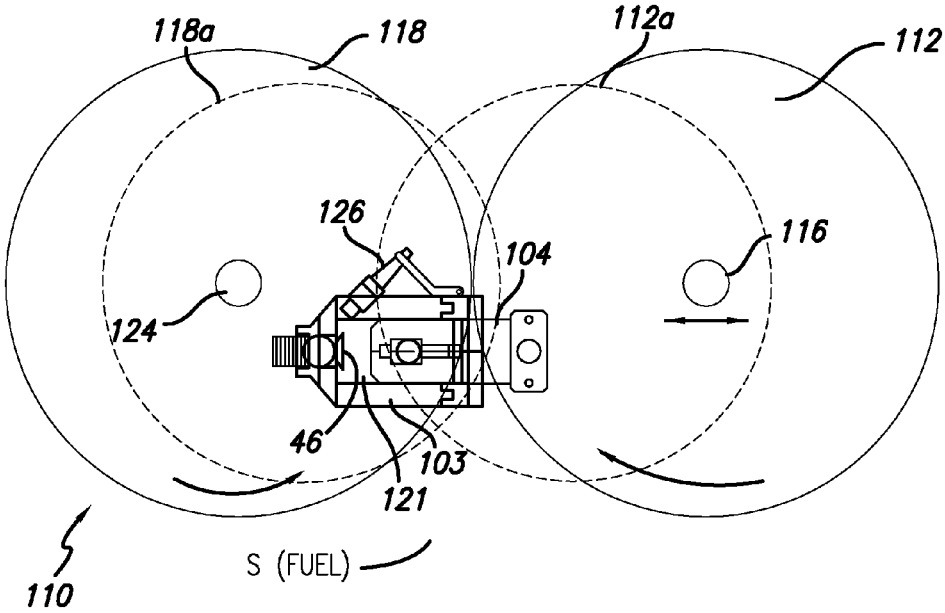

FIGS. 5-2 and 5-5 depict engine zone Z2 and show respectively the upper center and lower center portions of this embodiment of the invention engine 110. Principal gearing 117 for the engine 110 is again on the upper side supported by a further part of frame 115. Characteristic of the engine second zone Z1 is the presence of both a cylinder 103-2 and a piston 104-2 interfitted as in FIG. 3. Cylinder 103-2 and piston 104-2 are being carried on cylinder carrier wheel 118 having hub 82 and piston carrier wheel 112 having hub 81 both angularly upward (counter-rotating) in the Figures in an interfitted mode for immediate detonation upon their conjunction and subsequent cylinder 103-2 and piston 104-2 withdrawal from each other as they travel the wheel-defined arcuate paths 118*a*, 112*a*. Cylinder carrier wheel 118 is as described with reference to zone Z1. Piston cylinder wheel 112 comprises a lower side piston wheel plate 86 and a gear side piston wheel plate 85.

Cylinder 103-2 is as cylinder 103-1 was described in reference to zone Z1. Exhaust housing bushing 80 is shown on cylinder 103-1 for later registration with the exhaust housing (Zone Z2). Gearing 117 is supported on the frame 115 beyond the cylinder wheel 103-1. Piston 104-2 (and 104-3 in zone Z3) comprises a plug 104 forming the piston per se, and therewithin a piston cartridge 105 and an injector 34 communicating fuel supply S via a rotary union 57 and piston opening 134 with the cylinder volume 119 in the interfitted condition of the cylinder and piston 103-2, 104-2.

Spark plug 126 detonates the air fuel mixture, the exhaust valve 46 being closed. Exhaust housing bushing 80 on cylinder 103-2 is registered with exhaust housing 136 (Zone Z2). In some embodiments exhaust valve 46 is left partly open during piston entry into the cylinder volume 119 reducing the amount of air-fuel mixture to be compressed. The gearing 117 linking cylinder wheel hub 82 and piston wheel hub 81 is supported on the frame 115 on the side thereof opposite cylinder wheel 118.

Figure 3:
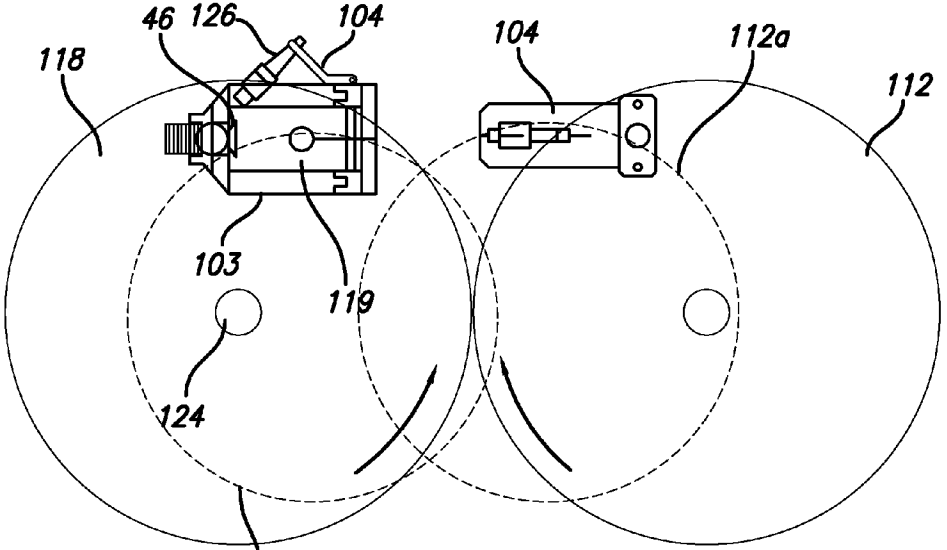

FIGS. 5-3 and 5-6 depict engine zone Z3 and show respectively the upper right and lower right sides of this embodiment of the invention engine 110. Characteristic of the engine third zone Z3 is the presence of an unengaged piston 104-3 that is being carried on piston carrier wheel 112 supported by hub 81 (zone Z2) angularly downward in the Figures in a cooling mode following detonation and piston withdrawal. Cylinder hub 81 extends normal to the plane of wheel 112 (parallel to the paper) and coincides with the wheel axis 116. Frame 115 having bearings 8 supports the hub 81 and thus the piston wheel 112 in journaled relation. The adjustment of the hub 81 relative to hub 82 to enable variation in compression within cylinder compression zone volume 121 is through linkages 76, 77 and displacement arm 78 in zone Z3.

A typical engine has a height of about 20 inches, a width of about 10 inches and a length of about 40 inches, and weighs about 300 pounds; cylinder bores can be 2.5-inch by 3-inch.

The invention engine thus meets the present need for engines offering the benefits of freedom from reciprocation-generated momentum changes, simplified construction, flexibility in fuels, variable output, high horsepower to weight ratios, and other benefits noted above, to better match the power and efficiency needs of a modern economy.

The foregoing objects are thus met.

We claim:

1. A combustible fluid operated piston and cylinder engine, comprising a series of cylinders in which each said cylinder has a longitudinal axis, is carried on a rotating cylinder wheel for orbital motion and is adapted to receive said combustible fluid, and a series of pistons carried on a counterrotating piston wheel for opposite orbital motion, each said piston having a cooperating said cylinder and having throughout its carriage the same longitudinal axis as its said cooperating cylinder to oppose and sequentially enter and completely withdraw from its said cooperating cylinder on said same longitudinal axis, said same longitudinal axis being at all times parallel to the respective longitudinal axes of each other cooperating cylinder and piston of said cylinder and piston series.

2. A combustible fluid operated piston and cylinder engine, comprising a series of cylinders carried on a rotating cylinder wheel for orbital motion and adapted to receive said combustible fluid, and a cooperating series of pistons carried on a rotating piston wheel for opposite orbital motion and arranged to coaxially oppose and sequentially enter and completely withdraw from respective ones of said cylinders, each of said cylinders and pistons being paraxial or coaxial with all other cylinders and pistons at all times during their said orbital motions, said pistons being arranged to deliver said combustible fluid to said cylinders.

3. The combustible fluid operated engine according to claim 1, in which said cylinder and piston wheels rotate on respective hubs, said hubs having plates defining said wheels, and including also a hub coupled power take off.

4. A combustible fluid operated piston and cylinder engine having a combustible fluid supply and comprising a cylinder carried on a rotating cylinder wheel for orbital motion and having a longitudinal axis, and a cooperating piston carried on a counterrotating piston wheel for opposite orbital motion and having throughout its carriage the same longitudinal axis as said cylinder, said piston being arranged to sequentially enter and completely withdraw from said cylinder in timed relation with delivery of said combustible fluid for combustible fluid compression, detonation and exhaust.

5. A combustible fluid operated piston and cylinder engine, comprising a series of cylinders carried on a rotating cylinder wheel for orbital motion and adapted to receive said combustible fluid, and a cooperating series of pistons carried on a rotating piston wheel for opposite orbital motion and arranged to coaxially oppose and sequentially enter and completely withdraw from respective ones of said cylinders, each of said cylinders and pistons being paraxial or coaxial with all other cylinders and pistons at all times during their said orbital motions, and in which each said cylinder has an exhaust port closable during piston entry in combustible fluid compression aiding relation.

6. The combustible fluid operate engine according to claim 5, in which said cylinder exhaust port is at least partially openable during entry of said piston in combustible fluid compression varying relation.

7. The combustible fluid operated engine according to claim 5, in which said cylinder exhaust port is open between successive piston entries into said cylinder in coolant passing relation into said cylinder.

8. The combustible fluid operated engine according to claim 7, in which said engine further includes an exhaust port control valve controlling between the open and closed states of said exhaust port in timed relation with said orbital motion of said cylinder.

9. A combustible fluid operated piston and cylinder engine, comprising a series of cylinders carried on a rotating cylinder wheel for orbital motion and adapted to receive said combustible fluid, and a cooperating series of pistons carried on a counterrotating piston wheel for opposite orbital motion and arranged to coaxially oppose and sequentially enter and completely withdraw from respective ones of said cylinders, each of said cylinders and pistons being paraxial or coaxial with all other cylinders and pistons at all times during their said orbital motions, each said cylinder having an exhaust port closable during piston entry in combustible fluid compression aiding relation.

10. The combustible fluid operate engine according to claim 9, in which said cylinder exhaust port is at least partially openable during entry of said piston in combustible fluid compression varying relation.

11. The combustible fluid operated engine according to claim 9, in which said cylinder exhaust port is open between successive piston entries into said cylinder in coolant passing relation into said cylinder.

12. The combustible fluid operated engine according to claim 11, in which said engine further includes an exhaust port control valve controlling between the open and closed states of said exhaust port in timed relation with piston entry into and withdrawal from said cylinder.

13. The combustible fluid operated engine according to claim 12, in which said cylinder and piston wheels are opposed edgewise and disposed in the same plane, and including also a frame supporting said cylinder and piston wheels.

14. The combustible fluid operated engine according to claim 13, in which said cylinder and piston wheels rotate on respective hubs journaled on said frame, and including also a hub coupled power take off.

15. The combustible fluid operated engine according to claim 2, in which said cylinder and piston wheels rotate on respective hubs, said hubs being relatively movable in piston stroke within said cylinder varying relation.

16. The combustible fluid operated engine according to claim 1, in which said series of cylinders is circularly distributed.

17. The combustible fluid operated engine according to claim 1, in which said series of pistons is circularly distributed.

18. The combustible fluid operated engine according to claim 17 in which said series of cylinders is circularly distributed.

19. The combustible fluid operated engine according to claim 18, including also a combustible fluid supply to said cylinders in timed relation with piston entry into said cylinder for compression, detonation and exhaust.

20. The combustible fluid operated engine according to claim 19, including also a combustible fluid detonator operatively associated with each cylinder.

21. The combustible fluid operated engine according to claim 20, in which said combustible fluid detonator comprises a spark plug.

22. A combustible fluid operated piston and cylinder engine comprising at least one cylinder or piston having a longitudinal axis and arranged for orbital motion on a first driven wheel extending in a plane, at least one cooperating piston or cylinder respectively having at all times the same longitudinal axis as said first driven wheel cylinder or piston and arranged for counter orbital motion on a second driving wheel extending in said plane, each said same longitudinal axis between a cylinder and piston being always parallel with all other same longitudinal axes during said orbital motions, said first and second wheels being relatively arranged to interfit periodically said piston and cylinder increasingly along said same longitudinal axis; and an energy supply to said cylinder for decreasing cylinder and piston interfittment.

23. The combustible fluid operated engine according to claim 22, including also a series of said cylinders each having a said longitudinal axis and a series of said pistons each having a said same longitudinal axis as a cooperating cylinder, all said longitudinal axes being at all time parallel with each other.

24. The combustible fluid operated engine according to claim 23, in which said cylinders and pistons are axle mounted and rotate about their respective axles counter to the rotation direction of their respective carrier wheels to maintain a single orientation of said cylinders and pistons that is characterized by said cylinders having the same longitudinal axis as their cooperating pistons, said single orientation maintaining all same said longitudinal axes at all times parallel with all other said same longitudinal axes.

25. The combustible fluid operated engine according to claim 22, in which said energy supply includes a combustible fluid supply in fluid communication with each said piston for delivery thereby into said respective ones of said cylinders in timed relation with piston cylinder entry for compression, detonation and exhaust.

26. A combustible fluid operated piston and cylinder engine comprising cylinders or pistons arranged for orbital motion on a first driven wheel extending in a plane, pistons or cylinders respectively arranged for counter orbital motion on a second driving wheel extending in said plane, said first and second wheels being relatively arranged to interfit periodically said pistons increasingly with said cylinders, each of said cylinders and pistons being paraxial or coaxial with all other cylinders and pistons at all times during their said orbital motions, and an energy supply to said cylinder for decreasing cylinder and piston interfittment each said cylinder having an exhaust port closable during piston entry in combustible fluid compression aiding relation.

27. The combustible fluid operate engine according to claim 26, in which said cylinder exhaust port is at least partially openable during entry of said piston in combustible fluid compression varying relation.

28. The combustible fluid operated engine according to claim 26, in which said cylinder exhaust port is open between successive piston entries into said cylinder in coolant passing relation into said cylinder.

29. The combustible fluid operated engine according to claim 26, in which said engine further includes an exhaust port control valve controlling between the open and closed states of said exhaust port in timed relation with said angular carriage of said cylinder.

30. The combustible fluid operated engine according to claim 22, in which each said cylinder has an exhaust port closable during piston entry in combustible fluid compression aiding relation.

31. The combustible fluid operated engine according to claim 23, including also a frame, and in which said cylinder and piston wheels rotate on respective hubs journaled on said frame, and including also a hub coupled power take off.

32. The combustible fluid operated engine according to claim 31, in which said respective hubs are relatively movable in piston stroke within said cylinder varying relation.

33. A combustible fluid operated piston and cylinder engine having a power output, said engine comprising a cooperating cylinder and piston having at all times the same longitudinal axis, a cylinder carrier wheel rotating on a cylinder carrier wheel hub and carrying said cylinder for orbital motion in a first angular direction, a piston carrier wheel rotating on a piston carrier wheel hub parallel to and spaced from said cylinder carrier wheel hub and carrying said piston for orbital motion in a second angular direction counter to said first angular direction, said cylinder and piston orbital motions locally intersecting in cylinder and piston increasing and then decreasing interfitting relation on said same longitudinal axis, a detonatable fuel supply for detonating fuel within said cylinder in piston and cylinder decreasing interfitting relation to drive a carrier wheel, said driven carrier wheel being coupled to said power output in driving relation.

34. A method of operating a combustible fluid operated piston and cylinder engine, including orbitally moving a cylinder having a longitudinal axis on a first circular path extending in a plane, oppositely orbitally moving a cooperating piston having the same longitudinal axis as said cylinder on a second circular path extending in said plane and that periodically intersects said first circular path in piston-in-cylinder increasing interfitting relation, supplying energy between said cylinder and said piston in piston and cylinder decreasing interfitting relation, and maintaining said cylinder and said piston on said same longitudinal axis at all times during their said orbital moving, said same longitudinal axis being in parallel with all other same said longitudinal axes if any at all times during said cylinder and piston orbital moving.

35. A method of operating a combustible fluid operated piston and cylinder engine, including sequentially interfitting a series of angularly carried cylinders in orbital motion with a series of cooperating angularly carried pistons in orbital motion, maintaining each said cylinder and its said cooperating piston on the same longitudinal axis and said same longitudinal axis parallel with all other same longitudinal axes between other cylinders and pistons if any at all times during their said orbital motions, said cylinders being adapted to receive said combustible fluid, and thereafter completely withdrawing said cooperating pistons from respective ones of said cylinders along said same longitudinal axis in combustible fluid introducing, compressing, detonating and exhausting relation repetitively as a function of said relative angular carriage of said cylinders and pistons.

36. The method according to claim 35, including also carrying said cylinders on a cylinder wheel, carrying said pistons on a piston wheel, counter-rotating said cylinder and piston wheels in edgewise opposed relation and disposed in the same plane.

37. A method of operating a combustible fluid operated piston and cylinder engine, including opposing and sequentially interfitting a series of angularly carried cylinders in orbital motion, each said cylinder having a longitudinal axis and adapted to receive said combustible fluid and a cooperating series of oppositely angularly carried pistons in orbital motion, each said piston having a longitudinal axis, maintaining said cylinder and piston longitudinal axes paraxial or coaxial with the longitudinal axes of all other cylinders and pistons at all times during their said orbital motions, thereafter completely withdrawing said pistons from respective ones of said cylinders in combustible fluid introducing, compressing, detonating and exhausting relation repetitively as a function of said relative angular carriage of said cylinders and pistons, and supplying a combustible fluid via each said piston into said respective ones of said cylinders in timed relation with piston cylinder entry for compression, detonation and exhaust.

38. The method according to claim 37, including also maintaining closed within said cylinder an exhaust port during piston entry in combustible fluid compression aiding relation.

39. The method according to claim 38, including also maintaining said cylinder exhaust port at least partially open during entry of said piston in combustible fluid compression varying relation.

40. The method according to claim 36, including also varying the spacing between said cylinder and piston wheels in piston stroke limiting relation.

41. A combustible fluid operated piston and cylinder engine, comprising a series of axially extended, interiorly open, cylindrical volume-defining cylinders carried on a cylinder wheel for orbital motion and adapted to receive said combustible fluid, and a series of axially extended cooperating pistons carried on a piston wheel for opposite orbital motion and arranged to sequentially enter and completely withdraw from respective ones of said cylinders, maintaining each said cylinder and its cooperating piston on the same longitudinal axis at all times during their said orbital motions, and maintaining all said same longitudinal axes parallel with all other same longitudinal axis at all times during said orbital motions.

42. A combustible fluid operated piston and cylinder engine having a power output, said engine comprising a cooperating cylinder and piston having at all times the same longitudinal axis, said cylinder being interiorly open and defining a cylindrical volume along said same longitudinal axis, a cylinder carrier wheel rotating on a cylinder carrier wheel hub and carrying said cylinder for orbital motion on a cylinder circular path in a first angular direction, a piston carrier wheel rotating on a piston carrier wheel hub parallel to and spaced from said cylinder wheel carrier hub and carrying said piston for orbital motion on a piston circular path in a second angular direction counter to said cylinder carrier wheel first angular direction, locally intersecting said cylinder and piston circular paths in cylinder and piston increasing and then decreasing axial interfitting relation along said same longitudinal axis, each said same longitudinal axis being at all times parallel with all other same longitudinal axes, supplying a detonatable fuel to said cylinder in piston and cylinder decreasing interfitting relation to drive a carrier wheel, said driven carrier wheel being coupled to said power output in driving relation.

43. A combustible fluid operated piston and cylinder engine, comprising plural pairs of cooperating cylinders and pistons, each said pair having at all times a common longitudinal axis, said cylinders and pistons being carried in orbital motion on oppositely rotating cylinder and piston carrier wheels respectively for sequential entry into and withdrawal from said cylinder of said piston in timed relation with delivery of said combustible fluid into said cylinder for compression, detonation and exhaust, each said common longitudinal axis being parallel with each other common longitudinal axis throughout said cylinder and piston orbital motions.

44. The combustible fluid operated engine according to claim 43, including also a combustible fluid supply to said cylinders.

45. The combustible fluid operated engine according to claim 43, in which said cylinder and piston wheels rotate on respective parallel hubs, said hubs having plates defining said wheels, and including also a hub coupled power take off.

46. The combustible fluid operated piston and cylinder engine according to claim 43, in which each said cylinder has an exhaust port closable during piston entry in combustible fluid compression aiding relation.

47. The combustible fluid operate engine according to claim 46, in which said cylinder exhaust port is at least partially openable during entry of said piston in combustible fluid compression varying relation.

48. The combustible fluid operated engine according to claim 43, in which said cylinder wheel and piston wheel are opposed edgewise and disposed in the same plane, and including also a frame supporting said cylinder and piston wheels.

49. The combustible fluid operated engine according to claim 48, in which said cylinder wheel and said piston wheel rotate on respective hubs journaled on said frame, and including also a hub coupled power take off.

50. The combustible fluid operated engine according to claim 43, in which said cylinder wheel and said piston wheel rotate on respective hubs, said hubs being relatively movable in piston stroke within said cylinder varying relation.

* * * * *